US011502401B2

(12) United States Patent
Sinha et al.

(10) Patent No.: US 11,502,401 B2
(45) Date of Patent: Nov. 15, 2022

(54) CONSTRUCTION BLOCK ANTENNA ASSEMBLY

(71) Applicants: Guruditya Sinha, New Delhi (IN); Reena Sinha, New Delhi (IN)

(72) Inventors: Guruditya Sinha, New Delhi (IN); Reena Sinha, New Delhi (IN)

( * ) Notice: Subject to any disclaimer, the term of this patent is extended or adjusted under 35 U.S.C. 154(b) by 79 days.

(21) Appl. No.: 17/212,230

(22) Filed: Mar. 25, 2021

(65) Prior Publication Data

US 2021/0305690 A1 Sep. 30, 2021

(30) Foreign Application Priority Data

Mar. 25, 2020 (IN) ..... 202041012962

(51) Int. Cl.

| | |
|---|---|
| ***H01Q 1/44*** | (2006.01) |
| ***E04C 1/39*** | (2006.01) |
| ***H01Q 9/04*** | (2006.01) |
| ***H01Q 1/48*** | (2006.01) |

(52) U.S. Cl.

CPC ..... *H01Q 1/44* (2013.01); *E04C 1/39* (2013.01); *H01Q 1/48* (2013.01); *H01Q 9/0421* (2013.01)

(58) Field of Classification Search

CPC ..... H01Q 1/44; H01Q 1/48; H01Q 9/0421; H01Q 1/007; H01Q 1/1221; H01Q 21/0025

See application file for complete search history.

(56) References Cited

U.S. PATENT DOCUMENTS

2019/0036209 A1* 1/2019 Au ..... H01Q 1/44

FOREIGN PATENT DOCUMENTS

WO WO-2007047418 A2 * 4/2007 ..... G01S 13/56

* cited by examiner

*Primary Examiner* — Hoang V Nguyen
(74) *Attorney, Agent, or Firm* — Chip Law Group

(57) ABSTRACT

Configurations of an electronic communication device, an electronic device or an antenna structure are described herein. The antenna structure includes a building construction block structure that provides a non-radiating portion of the antenna structure. A radiating element is formed on one side of the building construction block provides a radiating portion of the antenna structure. The radiating element may include a coating of a metallic element, such as copper. Further, the antenna structure includes a ground plane that is spaced apart from the radiating element on the building construction block structure. The ground plane may partially include a portion of the radiating element configured to adhere to the building construction block structure of the antenna structure. The antenna structure may passively transmit and/or receive signals and provisions flexibility of deployment in different configurations based on the applications.

16 Claims, 12 Drawing Sheets

CONSTRUCTION BLOCK ANTENNA ASSEMBLY

REFERENCE

This application claims the priority benefit of Indian Provisional Patent Application No. 202041012962, filed on Mar. 25, 2020. The entirety of the above-mentioned patent application is hereby incorporated by reference and made a part of this specification.

FIELD OF INVENTION

Various embodiments of the disclosure relate to an antenna structure or an electronic communication device that provides an interface for transmission and reception of electrical or electromagnetic waves in the space medium. More specifically, various embodiments of the disclosure relate to a construction block antenna assembly.

BACKGROUND

Technological evolutions have simplified the way humans communicate. As the evolution continues, end user devices have become portable and the design and deployment of the communication infrastructure facilitating such communication have simplified. Among various equipment for facilitating such communications, the communication infrastructure may include an antenna. The antenna may provide an interface between a transmitter and a receiver. The interface may facilitate the transmission or propagation of radio waves through space medium. The antenna may include an assembly of support structure, enclosure, etc., in addition to the actual functional components. A receiving antenna may include not only the receiving elements, but also an integrated preamplifier or mixer, especially at and above microwave frequencies. Multiple attributes or characteristics, such as radiation pattern, gain, bandwidth, frequency of operation, aperture, impedance matching, effect of ground, efficiency, etc. may be considered, to optimize the antenna design, deployment, and functions.

Limitations and disadvantages of conventional and traditional approaches will become apparent to one of skill in the art, through comparison of described systems with some aspects of the present disclosure, as set forth in the remainder of the present application and with reference to the drawings.

SUMMARY

An electronic communication device, an electronic device, and a structure for a block construction block antenna assembly, is described.

These and other features and advantages of the present disclosure may be appreciated from a review of the following detailed description of the present disclosure, along with the accompanying figures in which like reference numerals refer to like parts throughout.

DETAILED DESCRIPTION

Embodiments of techniques related to construction block antenna assembly from data associated with the media and entertainment industry are described herein.

In an embodiment, the subject specification describes antenna structures that may also be referred to as electronic devices that are designed to be an integral part of a wall or a building infrastructure. The antenna structures described herein may provision simplified design, ease of deployment, reduce associated costs and easy to maintain.

In an embodiment, the antenna structures may include a building construction block structure that may be a brick structure, or a block structure composed or fabricated of wood or concrete. The building block structure may be configured or adapted to provide a non-radiating portion or non-radiating part of the antenna structures. Further, a metallic element may be provided on one side of the building construction block structure. The metallic element may also be referred to as a radiating element including a metallic patch that may be configured or adapted to provide a radiating portion or radiating part of the antenna structures. Further, the antenna structures may include a ground plane that may be spaced apart from the radiating element on the building construction block structure. In an embodiment, the ground plane may include partially a portion of the radiating element that may be configured to adhere to the building construction block structure of the antenna structure.

Figure 1A:
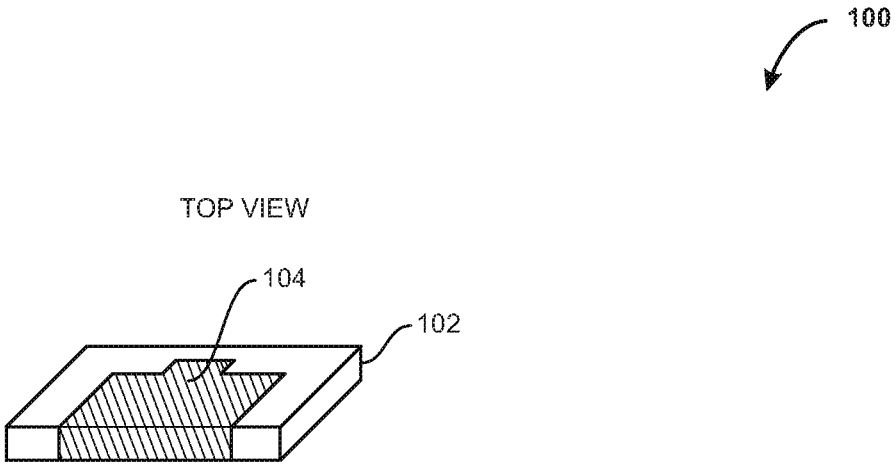
FIGS. 1A-1C show different views of a construction block antenna assembly, according to an exemplary embodiment.
Figure 1B:
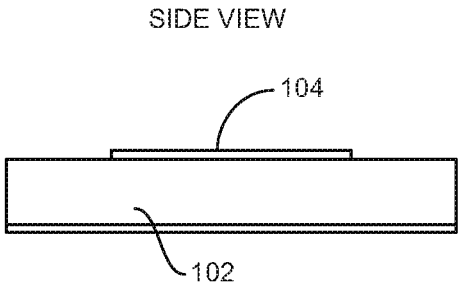
Figure 1C:
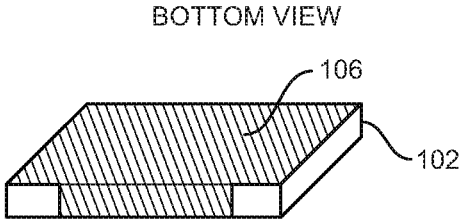

FIGS. 1A-1C show different views of a construction block antenna assembly 100, according to an exemplary embodiment. FIG. 1A, FIG. 1B and FIG. 1C respectively shows a top view, a bottom view, and a side view (also referred to as a stack up view) of a construction block antenna assembly 100. Referring to each of FIG. 1A, FIG. 1B and FIG. 1C, there is shown the construction block antenna assembly 100, which includes a building construction block structure 102, a radiating element 104, and a ground plane 106. The construction block antenna assembly 100 is hereinafter referred to as an antenna structure.

In an embodiment, the building construction block structure 102 may correspond to a block structure or a brick structure that may be used to construct walls, building infrastructures or alike. In an embodiment, the building construction block structure 102 may include a radiating element 104 on one side of the building construction block structure 102. For instance, the radiating element 104 may include a coating of metallic structural element, which may also be referred to as a metallic structure or metallic patch. In an embodiment, the radiating element 104 may also correspond to a substrate, for example a metallic substrate of a layer of copper. The metallic substrate including the radiating element 104 may be formed in a predefined portion on the surface of the building construction block structure 102. The metallic substrate may be provided as a coating around the building construction block structure 102. In an embodiment, the building construction block structure 102 may include a ground plane 106 that may be spaced apart from the radiating element 104 on the surface of the building construction block structure 102.

Referring to FIG. 1A and FIG. 1B, there is respectively shown the top view and the side view of the antenna structure 100. In an embodiment, the antenna structure 100 includes the building construction block structure 102 that may be, for example, a wooden block structure or a concrete block structure. The concrete block structure may correspond to a hollow concrete block, an aerated autoclaved concrete block, concrete bricks, solid concrete block, lintel block and concrete stretcher block, etc. In an embodiment, the concrete block structure may be composed of or manufactured using of cement, clay bearing soil, sand, lime, silica, styrene acrylic based polymers and non-combustible fillers, etc. The building construction block structure 102 may be used as a building infrastructure shell material for construction of infrastructures, for example, offices, homes, dams, etc. In an embodiment, the radiating element 104 may include, for example, copper. The radiating element 104 may be formed on one side of building construction block structure 102 and may provision an interface for passive transmission and reception of signals or waves.

Referring to FIG. 1C, there is shown the bottom view of the antenna structure 100. In an embodiment, the ground plane 106 may partially include a portion of the radiating element 104 and may be configured to adhere to the building construction block structure 102 of the antenna structure 100. In an embodiment, the ground plane 106 may be formed on the side opposite to the radiating element 104 on the surface of the building construction block structure 102.

In operation, the antenna structure 100 shown and described in FIGS. 1A-1C includes the building construction block structure 102, the radiating element 104 and the ground plane 106. The building construction block structure 102 may include a solid block that is non-metallic in composition and structure and may provide a non-radiating portion or non-radiating part of the antenna structure 100. Further, the radiating element 104 of the building construction block structure 102 may provide a radiating portion or radiating part of the antenna structure 100 and may facilitate passive transmission or reception of the signals. In an embodiment, the passive transmission or reception of the signals may be facilitated, for example, using edge feeding technique. In an embodiment, an edge feeding technique may include matching an impedance between a transmission line and radiation portion or radiating part of the antenna structure 100 using stubs and trace modifications that may operate or function as terminators. For example, by using a 50-ohm radio frequency (RF) terminator and the arrangement of the stubs or the trace modifications at the antenna structure 100 feeding ports or feeding elements, impedance between the transmission line and radiating patch or radiating portion of the antenna structure 100 may be matched. In an embodiment, such impedance matching using terminators may reduce the transmission losses due to reflection of the electrical signals (e.g., also referred to as return loss). The above described arrangement for impedance matching eliminates a need for using additional components or structural installations for the antenna structure 100. For example, this arrangement eliminates a need for any external cabling, structural modifications, or use of other components with the antenna structure 100. A connector (not shown) may be coupled to the ground plane by a metallic glazed contact such that the metaling glazed contact is in contact with feed elements of the antenna structure 100. In an embodiment, the antenna structure 100 may be fed using multiple antenna feeding techniques, for example, inset feeding, couple feeding, other types of edge feeding techniques, etc.

Figure 2A:
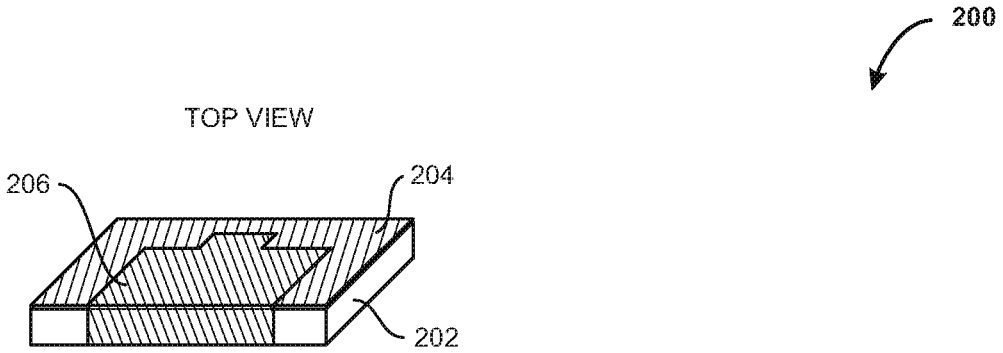
FIGS. 2A-2C show different views of a construction block antenna assembly, according to an exemplary embodiment.
Figure 2B:
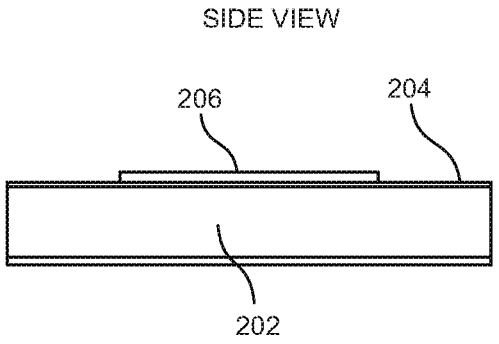
Figure 2C:
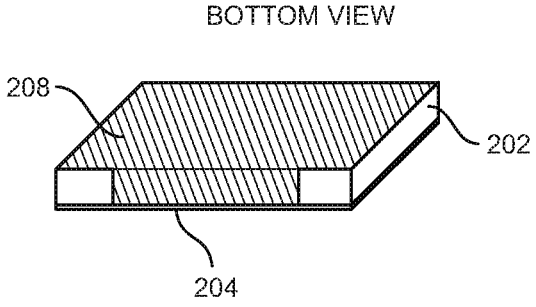

FIGS. 2A-2C show different views of a construction block antenna assembly 200, according to an exemplary embodiment. FIG. 2A, FIG. 2B and FIG. 2C respectively show a top view, a bottom view, and a side view (also referred to as a stack up view) of a construction block antenna assembly 200. Referring to each of FIG. 2A, FIG. 2B and FIG. 2C, there is shown the construction block antenna assembly 200, which includes a building construction block structure 202, a dielectric substrate 204, a radiating element 206, and a ground plane 208. The construction block antenna assembly 200 is hereinafter referred to as an antenna structure.

In an embodiment, the building construction block structure 202 may correspond to a block structure or a brick structure that may be used to construct walls, building infrastructures or alike. In an embodiment, the antenna structure 200 may include a dielectric substrate 204 that may be formed via a lamination or cohesion or adhesively adhesion or bonding onto the building construction block structure 202. In an embodiment, the building construction block structure 202 may include the radiating element 206 on one side of the building construction block structure 202 coated over the dielectric substrate 204. In an embodiment, the radiating element 206 may include a coating of metallic structural element, which may also be referred to as a metallic structure or metallic patch. The radiating element 206 including copper layer may be provided as a coating or may be glaze printed on a plastic sheet and the plastic sheet may be adhesively bonded to the building construction block structure 202. The thickness of the aforementioned arrangement including the combination of the dielectric substrate 204 and the radiating element 206 may approximately be, for example, 50 microns. In an embodiment, the antenna structure 200 may include a ground plane 208 that may be spaced apart from the radiating element 206 on the surface of the building construction block structure 202.

Referring to FIG. 2A and FIG. 2B, there is respectively shown the top view and the side view of the antenna structure 200. In an embodiment, the antenna structure 200 includes the building construction block structure 202 that may be, for example, a wooden block structure or a concrete block structure. In an embodiment, the concrete block structure may correspond to a hollow concrete block, an aerated autoclaved concrete block, concrete bricks, solid concrete block, lintel block and concrete stretcher block, etc. The concrete block structure may be composed of or manufactured using of cement, clay bearing soil, sand, lime, silica, styrene acrylic based polymers and non-combustible fillers, etc. The building construction block structure 202 may be used as a building infrastructure shell material for construction of infrastructures, for example, offices, homes, dams, etc. In an embodiment, the dielectric substrate 204 may include, for example, a sheet of plastic. The plastic sheet may be formed or composed of polyvinyl chloride (PVC) compound. In an embodiment, the radiating element 206 may include, for example, copper. The radiating element 206 may be formed on one side of building construction block structure 206 and may provision an interface for passive transmission and reception of signals or waves.

Referring to FIG. 2C, there is shown the bottom view of the antenna structure 200. In an embodiment, the ground plane 206 may partially include a portion of the dielectric substrate 204 and the radiating element 206 and may be configured to adhere to the building construction block structure 202 of the antenna structure 200. In an embodiment, the ground plane 208 may be formed on the side opposite to the radiating element 206 on the surface of the building construction block structure 202.

In operation, the antenna structure 200 shown and described in FIGS. 2A-2C includes the building construction block structure 202, the dielectric substrate 204, the radiating element 206 and the ground plane 208. The building construction block structure 202 may include a solid block that is non-metallic in composition and structure and may provide a non-radiating portion or non-radiating part of the antenna structure 200. Further, the radiating element 206 of the building construction block structure 202 may provide a radiating portion or radiating part of the antenna structure 200 and may facilitate passive transmission or reception of the signals. In an embodiment, the passive transmission or reception of the signals may be facilitated, for example, using edge feeding technique. In an embodiment, edge feeding technique may include matching an impedance between a transmission line and radiation portion or radiating part of the antenna structure 200 using stubs and trace modifications that may operate or function as terminators. For example, by using a 50-ohm radio frequency (RF) terminator and the arrangement of the stubs or the trace modifications at the antenna structure feeding ports or feeding elements, impedance between the transmission line and radiating patch or radiating portion of the antenna structure 200 may be matched. In an embodiment, such impedance matching using terminators may reduce the transmission losses due to reflection of the electrical signals (e.g., also referred to as return loss). The above described arrangement for matching impedance eliminates a need for using additional components or structural installations for the antenna structure 200. For example, this arrangement eliminates a need for any external cabling, structural modifications, or use of other components with the antenna structure 200. A connector (not shown) may be coupled to the ground plane by a metallic glazed contact such that the metaling glazed contact is in contact with feed elements of the antenna structure 200. In an embodiment, the antenna structure 200 may be fed using multiple antenna feeding techniques, for example, inset feeding, couple feeding, other types of edge feeding techniques, etc.

Figure 3:
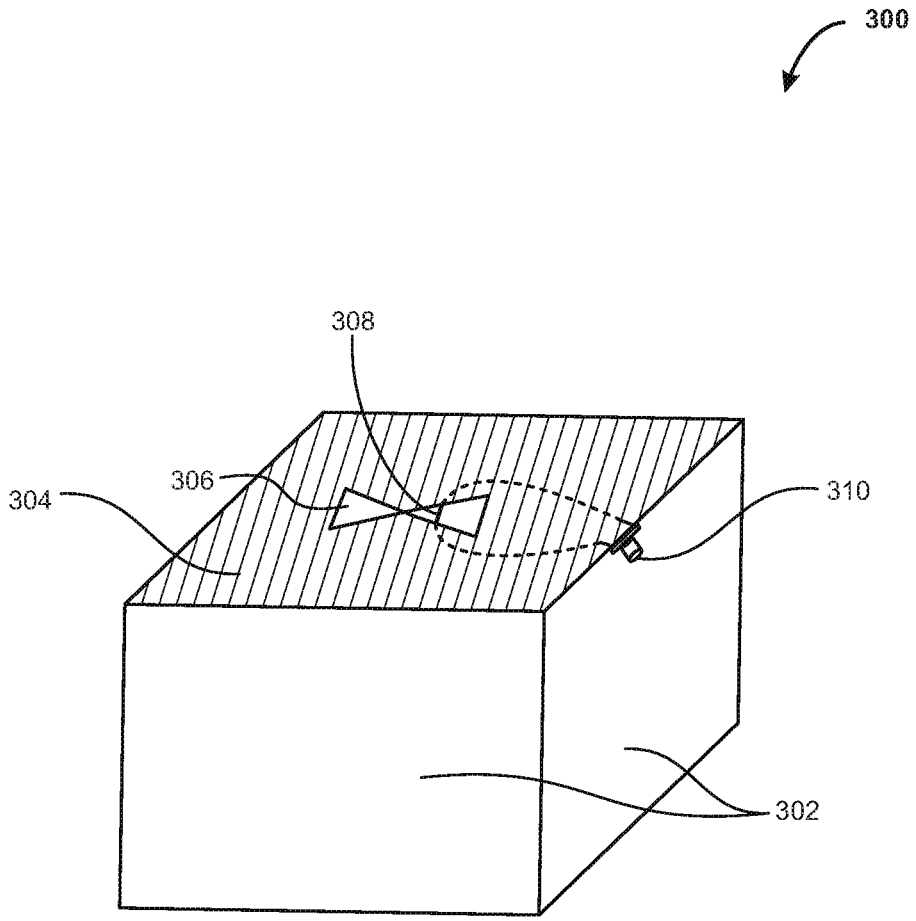
FIG. 3 shows a bowtie configuration of a construction block antenna assembly, according to an exemplary embodiment.

FIG. 3 shows a bowtie configuration of a construction block antenna assembly 300, according to an exemplary embodiment. FIG. 3 is described in conjunction with FIGS. 1A-1C and FIGS. 2A-2C. Referring to FIG. 3, there is shown the construction block antenna assembly 300, which includes a building construction block structure 302, a radiating element 304, an etching in a shape of a bowtie 306 and an antenna port 308. The construction block antenna assembly 300 is hereinafter referred to as an antenna structure. In an embodiment, the building construction block structure 302 may correspond to a block structure that may be used to construct walls, building infrastructures or alike. In an embodiment, the building construction block structure 302 may include the radiating element 304 on one side of the building construction block structure 302. For instance, the radiating element 304 may include a coating of metallic structural element, such as copper.

Referring to FIG. 3, there is shown the bowtie configuration of the antenna structure 300. In an embodiment, the antenna structure 300 includes the building construction block structure 302 that may be, for example, a concrete block structure. In an embodiment, the concrete block structure may correspond to an aerated autoclaved concrete block, concrete bricks, solid concrete block, lintel block and concrete stretcher block, etc. The concrete block structure be fabricated or manufactured using of cement, clay bearing soil, sand, lime, silica, styrene acrylic based polymers and non-combustible fillers, etc. The building construction block structure 302 may be used as a building infrastructure shell material for construction of infrastructures, for example, offices, homes, dams, etc. In an embodiment, the radiating element 304 may include, for example, copper. The radiating element 304 may be formed on one side of building construction block structure 302 and may provision an interface for passive transmission and reception of signals or waves.

In operation, the antenna structure 300 includes the building construction block structure 302, the radiating element 304, the etching shaped as the bowtie 306 and the antenna port 308. The building construction block structure 302 may include a solid block that is non-metallic in composition and structure and may provide a non-radiating portion or non-radiating part of the antenna structure 300. Further, the radiating element 304 of the building construction block structure 302 may provide a radiating portion or radiating part of the antenna structure 300 and may facilitate passive transmission or reception of the signals. In an embodiment, the passive transmission or reception of the signals may be facilitated, for example, using edge feeding technique, as described in the detailed description of with FIGS. 1A-1C and FIGS. 2A-2C.

In an embodiment, the antenna structure 300 may be fed via edge feeding technique through a connector 310 that is configured to be connected to the antenna port 308. The connector 310 may edge feed the antenna structure 300 via the antenna port 308, that is shown via dashed lines. In an embodiment, the antenna port 308 may also be referred to as feed elements of the antenna structure 300. In another embodiment, the side including the radiating element (e.g., 304 in FIG. 3) may be a solid non-metallic block structure providing the non-radiating portion of the antenna structure and the etched bowtie shape (e.g., 306 in FIG. 3) may be coated with a metallic element, for example, copper. In this arrangement, the bowtie shape may form the radiating element (e.g., 304) providing the radiating portion of the antenna structure 300.

Figure 4:
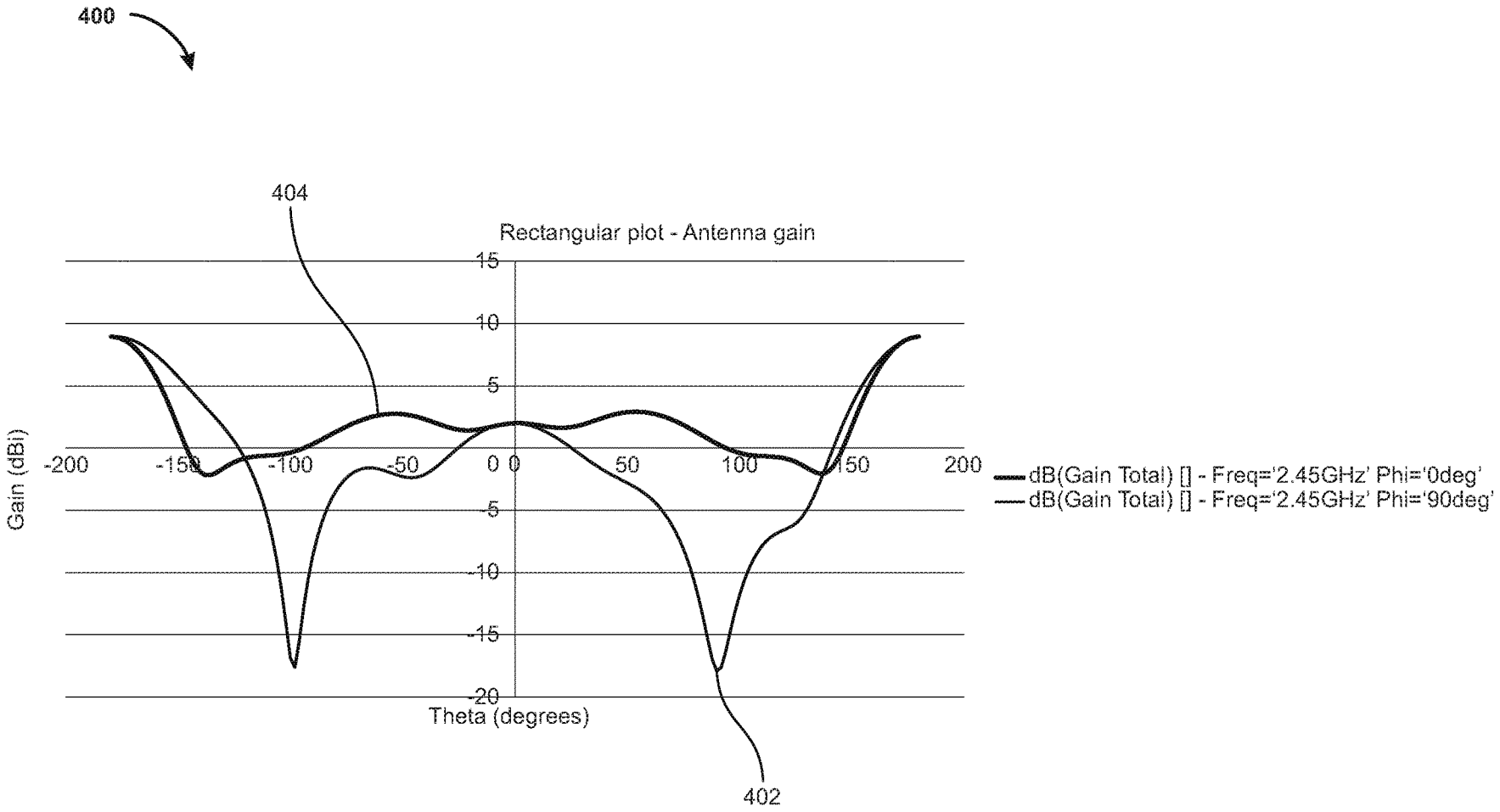
FIG. 4 illustrates a rectangular plot including an antenna gain for a bowtie configuration of a construction block antenna assembly, according to an exemplary embodiment.

FIG. 4 illustrates a rectangular plot including an antenna gain for a bowtie configuration of a construction block antenna assembly, according to an exemplary embodiment. FIG. 4 is described in conjunction with FIG. 3. Referring to FIG. 4, there is shown a rectangular plot of an antenna gain 400 for the bowtie configuration of the antenna structure 300. In an embodiment, an antenna's gain may correspond to power gain that may describe the efficiency of the antenna. For instance, during transmission, the antenna gain may correspond to the efficacy of the antenna structure 300 to convert the input power into radio waves headed in a specified direction. During reception, the antenna gain may correspond to the efficacy of the antenna structure 300 to convert the radio waves arriving from a specified direction into electrical power. In an embodiment, the antenna gain may therefore correspond to the efficacy of the antenna structure to radiate radio signals in a specific direction as compared to a theoretical isotopically radiating antenna. Referring to FIG. 4, curves 402 and 404 may indicate the radiation pattern in terms of the antenna gain. The rectangular plot of the antenna gain 400 for the bowtie configuration of the antenna structure 300 shows a plot of antenna gain versus angle from the bore sight in the elevation plane.

Figure 5:
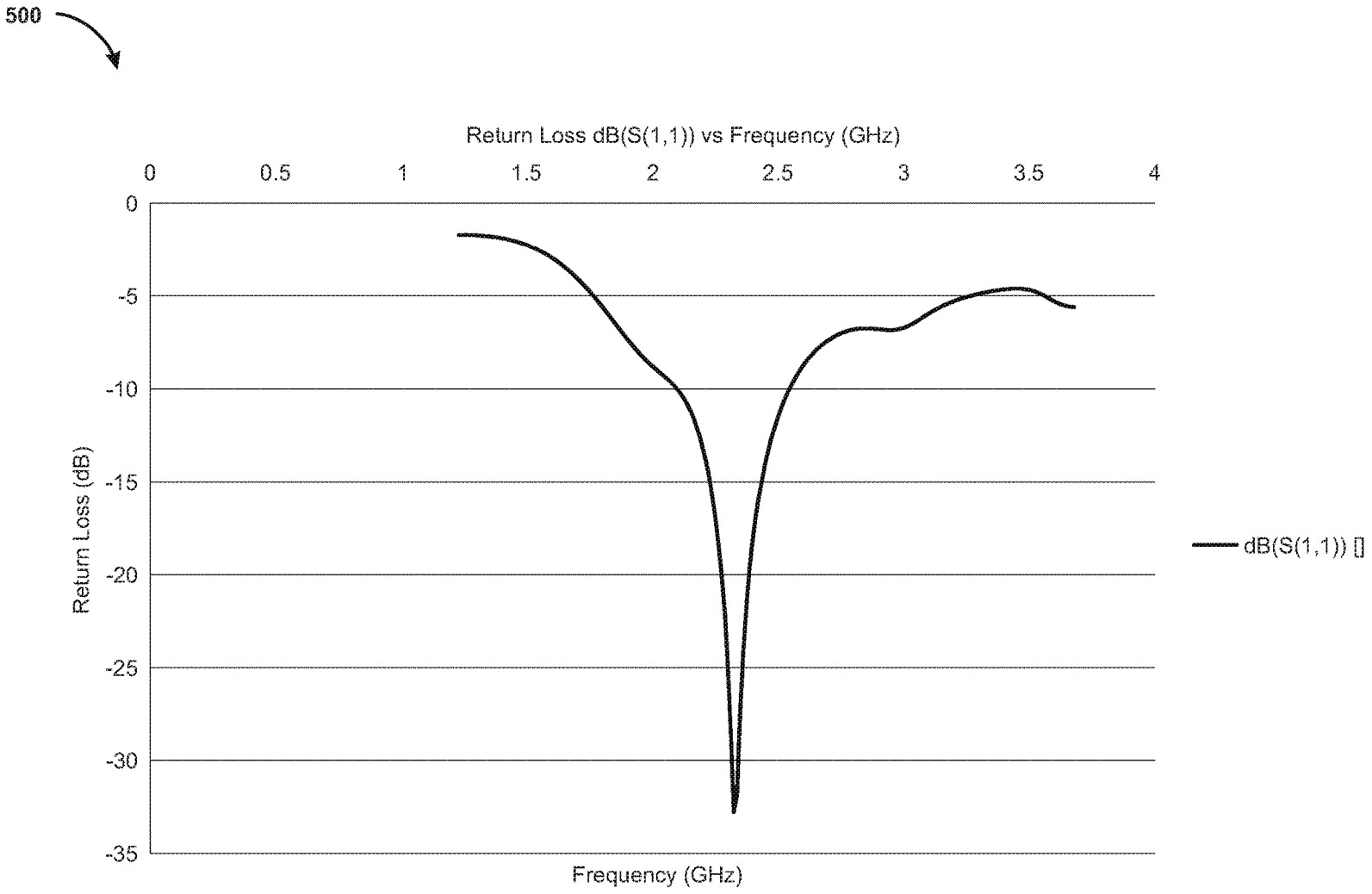
FIG. 5 illustrates a return loss curve for a bowtie configuration of a construction block antenna assembly, according to an exemplary embodiment.

FIG. 5 illustrates a return loss curve for a bowtie configuration of a construction block antenna assembly, according to an exemplary embodiment. FIG. 5 is described in conjunction with FIG. 3. In an embodiment, return loss corresponds to or is a measure of how small the "return" or reflection of a signal is. A large amount of loss on the return echo is generally desirable as it ensures that the signal strength going into the antenna is reasonably acceptable. In an embodiment, the return loss is typically measured on a "dB" logarithmic scale. In an embodiment, return loss is a key parameter that is used to assess the useability of an antenna design with the rest of electronic circuit working cooperatively with the antenna structure. Referring to FIG. 5, there is shown a return loss curve 500 for the bowtie configuration of the construction block antenna assembly 300. The return loss curve 500 corresponds to bowtie configuration of the construction block antenna assembly 300 that includes a concrete block structure. In an embodiment, return loss is a key parameter used to assess the useability of a design of an antenna structure with the rest of circuit, which are generally matched to 50 ohm impedance. The return loss curve is in close proximity to 10 dB for the desired frequency band between 2.0 GHz-2.5 GHz. The return loss curve 500 indicates an impedance match that is ideal with return loss of 10 dB. With a return loss of 10 dB return loss, smore that 90% of available power is being delivered to the bowtie configuration of the construction block antenna assembly 300.

Figure 6:
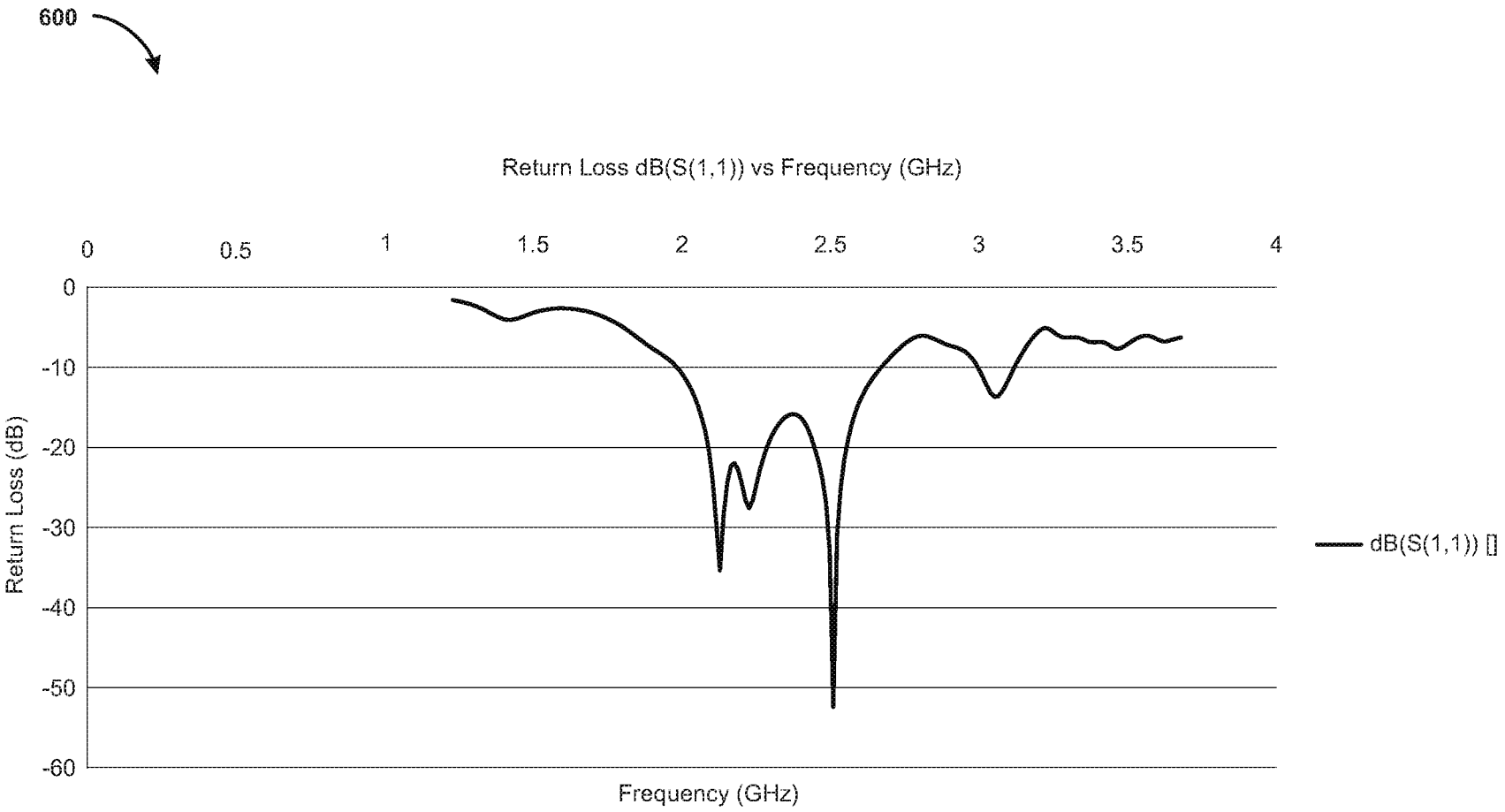
FIG. 6 illustrates a return loss curve for a bowtie configuration of a construction block antenna assembly, according to an exemplary embodiment.

FIG. 6 illustrates a return loss curve for a bowtie configuration of a construction block antenna assembly, according to an exemplary embodiment. FIG. 6 is described in conjunction with FIG. 3. In an embodiment, return loss corresponds to or is a measure of how small the "return" or reflection of a signal is. A large amount of loss on the return echo is generally desirable as it ensures that the signal strength going into the antenna is reasonably acceptable. In an embodiment, the return loss is typically measured on a "dB" logarithmic scale. In an embodiment, return loss is a key parameter that is used to assess the useability of an antenna design with the rest of electronic circuit working cooperatively with the antenna structure. Referring to FIG. 6, there is shown a return loss curve 600 for the bowtie configuration the construction block antenna assembly 300. The return loss curve 600 corresponds to bowtie configuration of the construction block antenna assembly 300 that includes the concrete brick structure. The return loss curve 600 indicates the return loss is in close proximity to about 10 dB in the desired frequency band of 2.0 GHz and 2.7 GHz. Further, the return loss curve 600 indicates an impedance match that is ideal with return loss of 10 dB. With a return loss of 10 dB return loss, smore that 90% of available power is being delivered to the bowtie configuration of the construction block antenna assembly 300.

Figure 7:
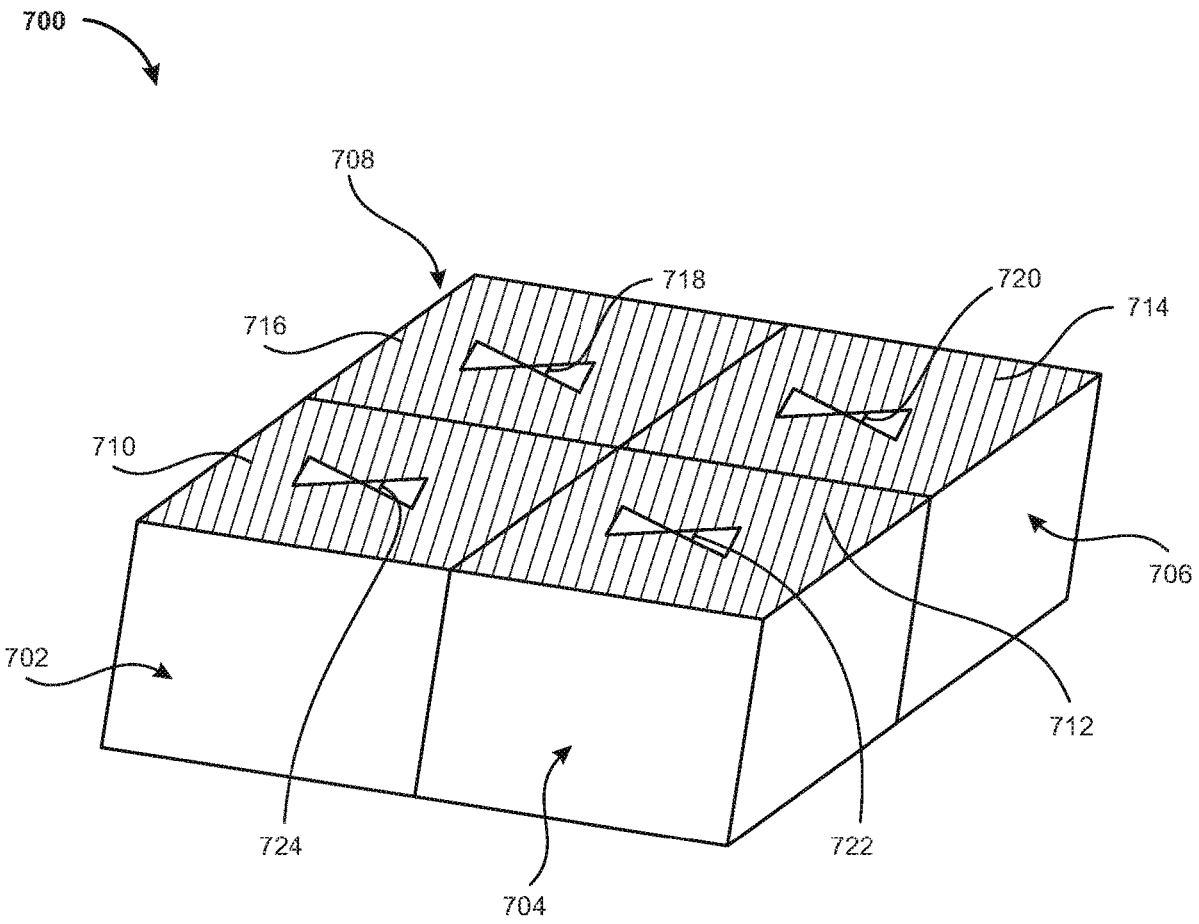
FIG. 7 shows an array of a bowtie configuration of a construction block antenna assembly, according to an exemplary embodiment.

FIG. 7 shows an array of a bowtie configuration of a construction block antenna assembly 700, according to an exemplary embodiment. FIG. 7 is described in conjunction with FIGS. 1A-1C, and FIGS. 2A-2C. Referring to FIG. 7, there is shown an arrangement of a 2×2 array of the bowtie configuration of the construction block antenna assembly 700. The array of the bowtie configuration of the construction block antenna assembly 700 includes the building construction block structures 702, 704, 706, 708 that may be, for example, a concrete block structure. In an embodiment, the concrete block structure may correspond to an aerated autoclaved concrete block, concrete bricks, solid concrete block, lintel block and concrete stretcher block, etc. The concrete block structure may be composed of or manufactured using of cement, clay bearing soil, sand, lime, silica, styrene acrylic based polymers and non-combustible fillers, etc. The building construction block structures 702, 704, 706, 708 may be used as a building infrastructure shell material for construction of infrastructures, for example, offices, homes, dams, etc. In an embodiment, the radiating element 710, 712, 714, 716 may include, for example, copper. The radiating elements 710, 712, 714, 716 may be respectively formed on one side of the building construction block structures 702, 704, 706, 708 and may provision an interface for passive transmission and reception of signals or waves.

In operation, the antenna structure 700 includes the building construction block structures 702, 704, 706, 708, the radiating element 710, 712, 714, 716, the etching shaped as a bowtie and the antenna ports 718, 720, 722 and 724. The building construction block structure 702, 704, 706, 708 may include a solid block that is non-metallic in composition and structure and may provide a non-radiating portion or non-radiating part of the bowtie configuration of the construction block antenna assembly 700. Further, the radiating element 702, 704, 706, 708 of the building construction block structure 702, 704, 706, 708 may provide a radiating portion or radiating part of the bowtie configuration of the construction block antenna assembly 700 and may facilitate passive transmission or reception of the signals. In an embodiment, the passive transmission or reception of the signals may be facilitated, for example, using edge feeding technique, as described in FIGS. 1A-1C and FIGS. 2A-2C.

Figure 8:
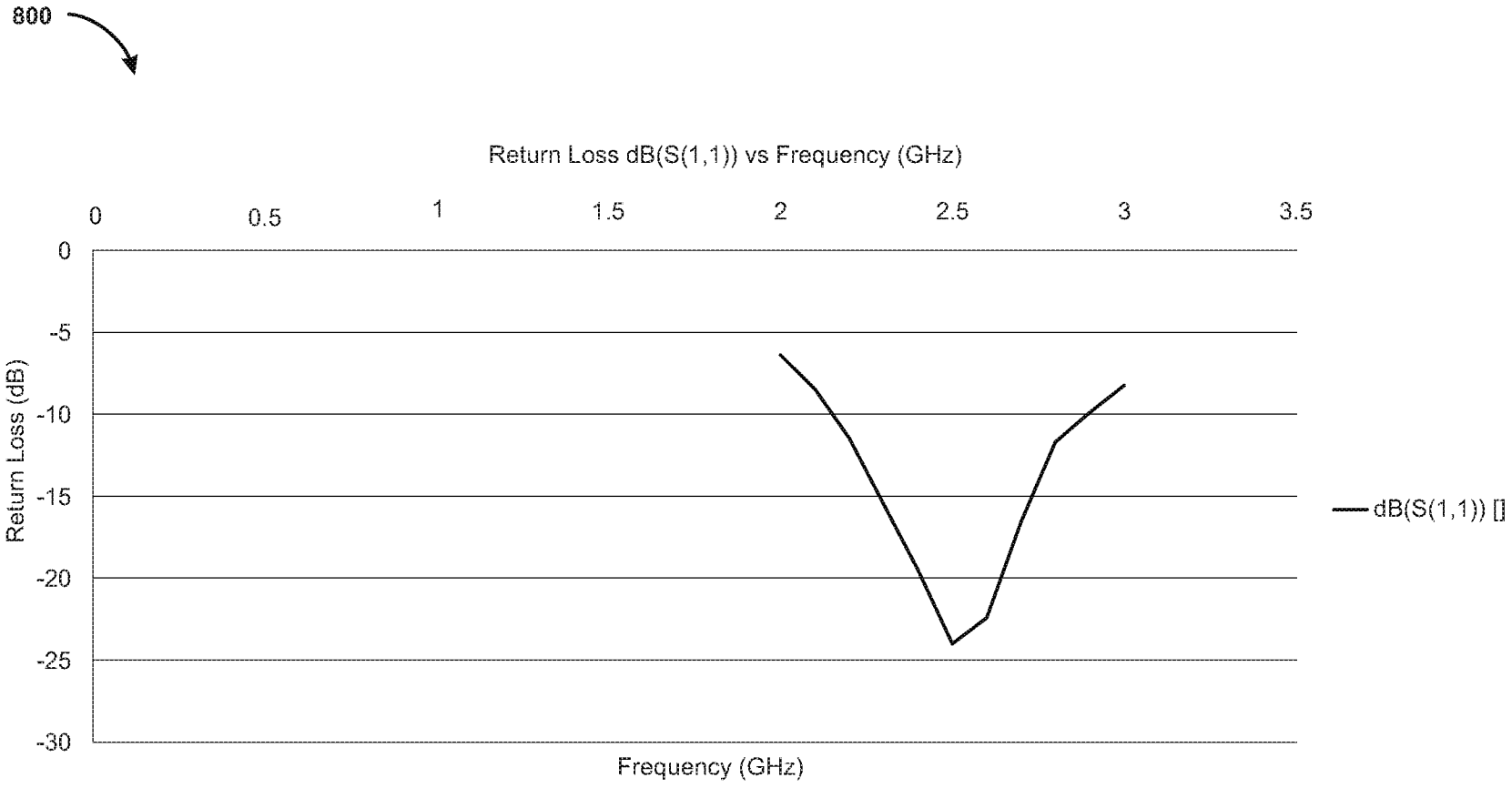
FIG. 8 illustrates a return loss curve for an array of a bowtie configuration of a construction block antenna assembly, according to an exemplary embodiment.

FIG. 8 illustrates a return loss curve 800 for an array of a bowtie configuration of a construction block antenna assembly, according to an exemplary embodiment. FIG. 8 is described in conjunction with FIG. 3 and FIG. 7. Referring to FIG. 8, there is shown a return loss curve 800 for of the bowtie configuration of the construction block antenna assembly 700. The return loss curve 800 indicates that the return loss is in close proximity to about 10 dB for the frequency band between 2.0 GHz and 2.85 GHz. Further, the return loss curve 800 indicates indicate an impedance match that is ideal with return loss of 10 dB. With a return loss of 10 dB return loss, smore that 90% of available power is being delivered to the bowtie configuration of the construction block antenna assembly 700.

Figure 9:
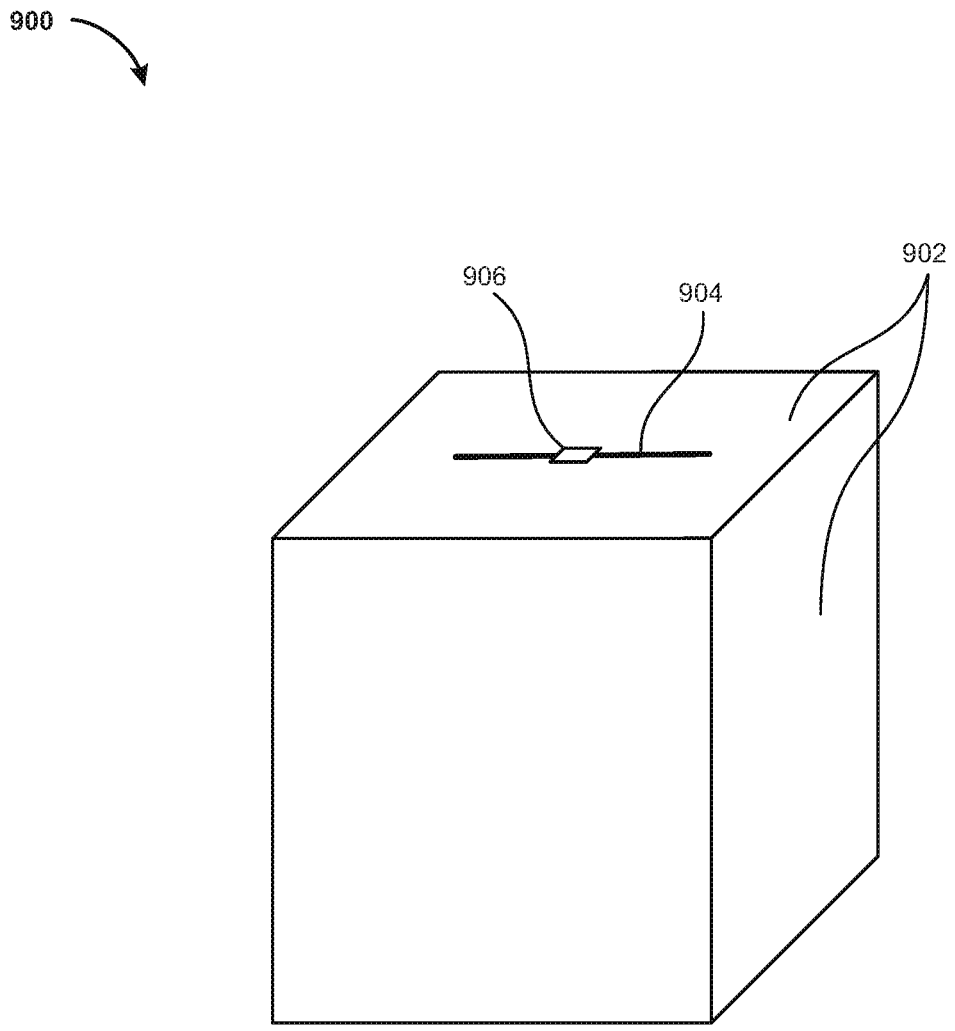
FIG. 9 shows a dipole configuration of a construction block antenna assembly, according to an exemplary embodiment.

FIG. 9 shows a dipole configuration of a construction block antenna assembly 900, according to an exemplary embodiment. FIG. 9 is described in conjunction with FIGS. 1A-1C and FIGS. 2A-2C. Referring to FIG. 9, there is shown the construction block antenna assembly 900, which includes a building construction block structure 902, a radiating element 904, and an antenna port 906. The construction block antenna assembly 900 is hereinafter referred to as an antenna structure. In an embodiment, the building construction block structure 902 may correspond to a block structure that may be used to construct walls, building infrastructures or alike. In an embodiment, the building construction block structure 902 may include a radiating element 904 on one side of the building construction block structure 902. For instance, the radiating element 904 may include a coating of metallic structural element, such as copper.

Referring to FIG. 9, there is shown a top view of the dipole configuration of the antenna structure 900. In an embodiment, the antenna structure 900 includes the building construction block structure 902 that may be, for example, a concrete block structure. In an embodiment, the concrete block structure may correspond to an aerated autoclaved concrete block, concrete bricks, solid concrete block, lintel block and concrete stretcher block, etc. The concrete block structure may be composed of or manufactured using of cement, clay bearing soil, sand, lime, silica, styrene acrylic based polymers and non-combustible fillers, etc. The building construction block structure 902 may be used as a building infrastructure shell material for construction of infrastructures, for example, offices, homes, dams, etc. In an embodiment, the radiating element 904 may include, for example, copper. The radiating element 904 may be formed on one side of building construction block structure 902 and may provision an interface for passive transmission and reception of signals or waves.

In operation, the antenna structure 900 shown and described in FIG. 9 includes the building construction block structure 902, the radiating element 904 and the antenna port 906. The building construction block structure 902 may include a solid block that is non-metallic in composition and structure and may provide a non-radiating portion or non-radiating part of the antenna structure 900. Further, the radiating element 904 of the building construction block structure 902 may provide a radiating portion or radiating part of the antenna structure 900 and may facilitate passive transmission or reception of the signals. In an embodiment, the passive transmission or reception of the signals may be facilitated, for example, using edge feeding technique. The antenna structure 900 may also be referred to as printed dipole antenna structure. The metallic structural element 902 may include the port 904 that can edge feed the antenna structure. In an embodiment, the passive transmission or reception of the signals may be facilitated, for example, using edge feeding technique, as described in the detailed description of with FIGS. 1A-1C and FIGS. 2A-2C.

Figure 10:
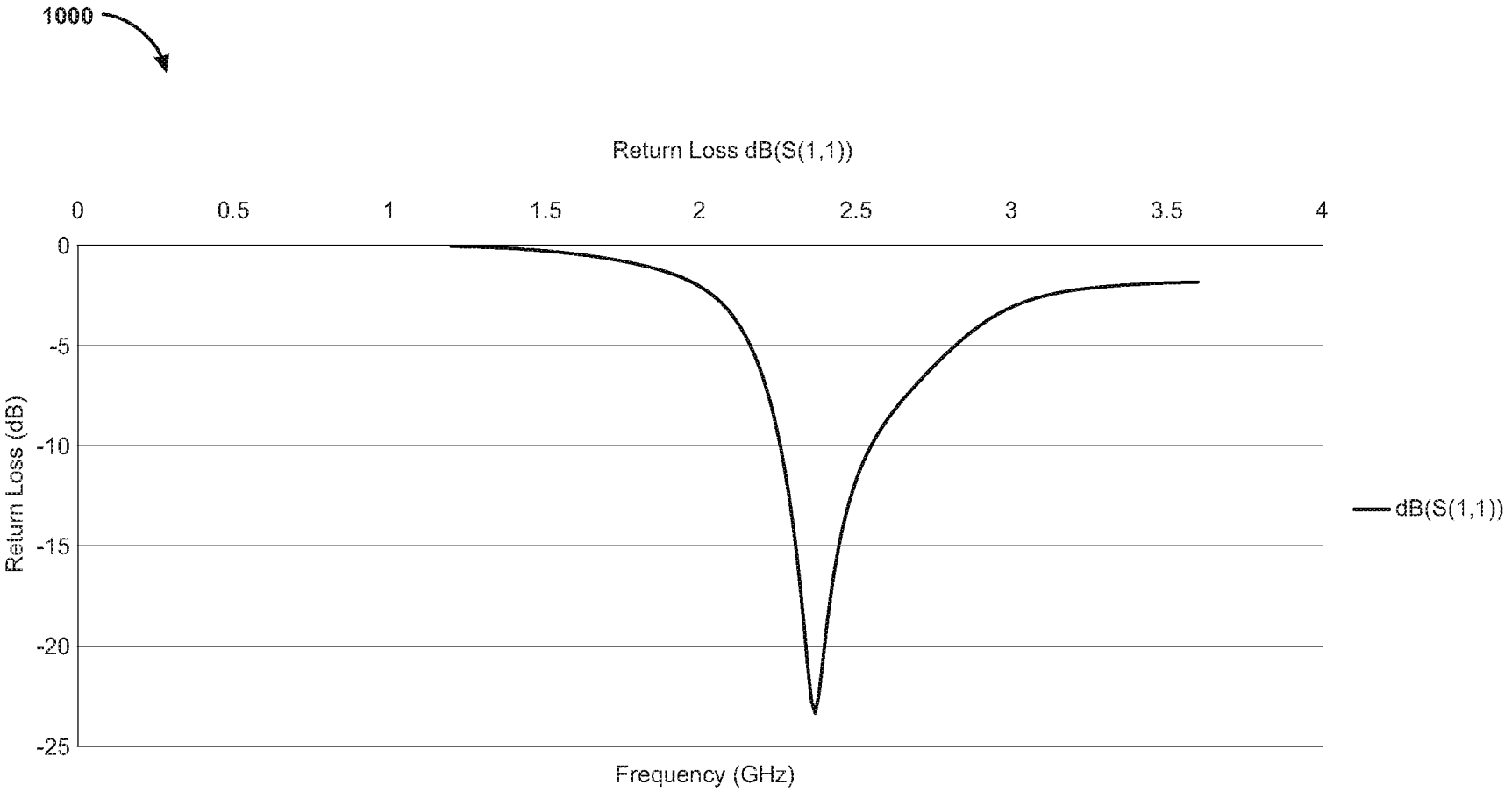
FIG. 10 illustrates a return loss curve for a dipole configuration of a construction block antenna assembly, according to an exemplary embodiment.

FIG. 10 illustrates a return loss curve 1000 for a dipole configuration of a construction block antenna assembly, according to an exemplary embodiment. Referring to FIG. 10, there is shown a return loss curve 1000 for a dipole configuration of the construction block antenna assembly 900. FIG. 10 is described in conjunction with FIG. 9. In an embodiment, return loss corresponds to or is a measure of how small the "return" or reflection of a signal is. A large amount of loss on the return echo is generally desirable as it ensures that the signal strength going into the antenna is reasonably acceptable. In an embodiment, the return loss is typically measured on a "dB" logarithmic scale. In an embodiment, return loss is a key parameter that is used to assess the useability of an antenna design with the rest of electronic circuit working cooperatively with the antenna structure. The return loss curve 1000 corresponds to dipole configuration of the construction block antenna assembly 900 that includes a concrete block structure. In an embodiment, return loss is a key parameter used to assess the useability of a design of an antenna structure with the rest of circuit, which are generally matched to 50 ohm impedance. The return loss curve is in close proximity to 10 dB for the desired frequency band between 2.0 GHz-2.5 GHz. The return loss curve 1000 indicates an impedance match that is ideal with return loss of 10 dB. With a return loss of 10 dB return loss, smore that 90% of available power is being delivered to dipole configuration of the construction block antenna assembly 900.

Figure 11:
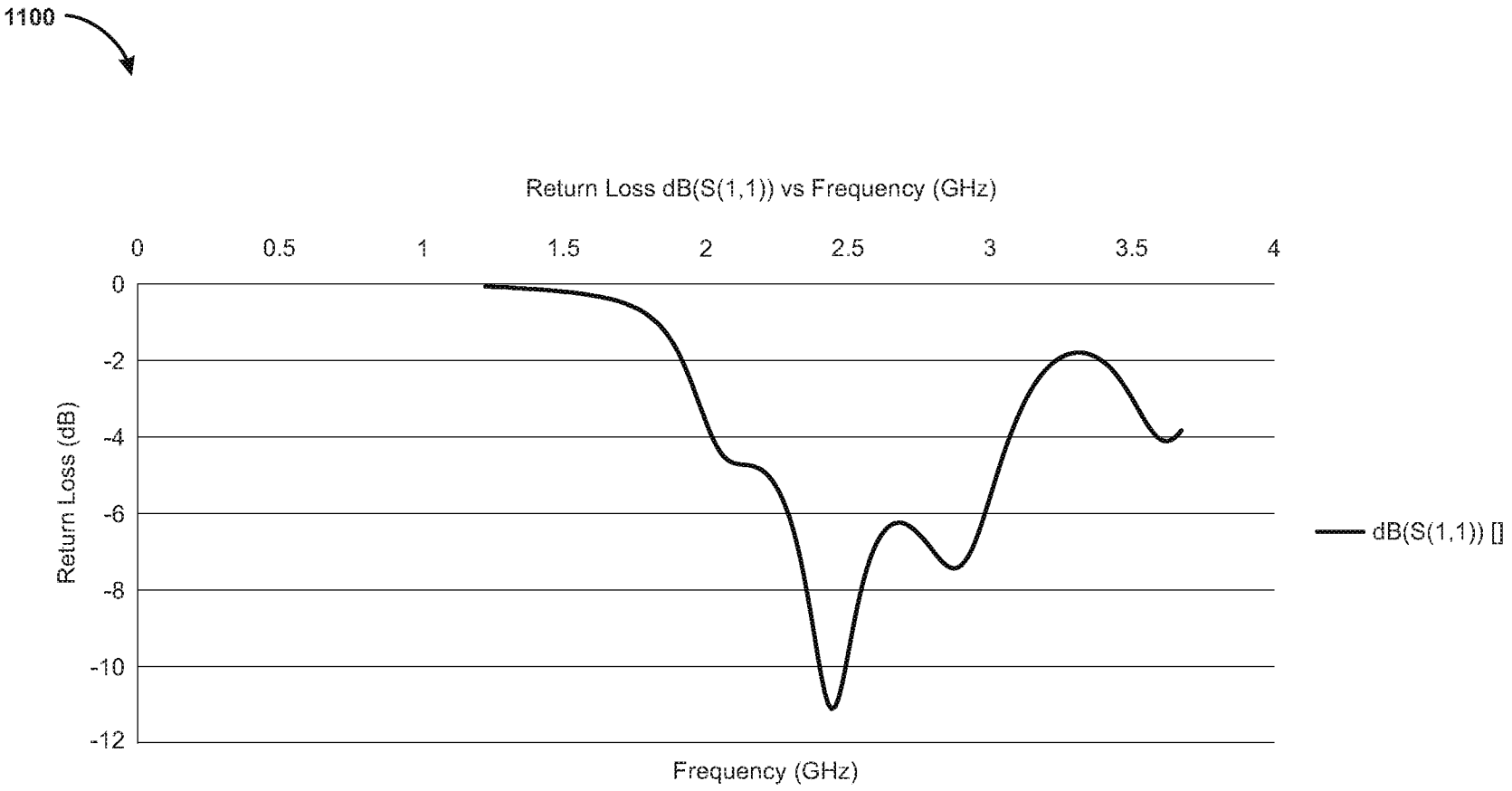
FIG. 11 illustrates a return loss curve for a dipole configuration of a construction block antenna assembly, according to an exemplary embodiment.

FIG. 11 illustrates a return loss curve 1100 for a dipole configuration of a construction block antenna assembly, according to an exemplary embodiment. Referring to FIG. 11, there is shown a return loss curve 1100 for a dipole configuration of the construction block antenna assembly 900. FIG. 11 is described in conjunction with FIG. 9. In an embodiment, return loss corresponds to or is a measure of how small the "return" or reflection of a signal is. A large amount of loss on the return echo is generally desirable as it ensures that the signal strength going into the antenna is reasonably acceptable. In an embodiment, the return loss is typically measured on a "dB" logarithmic scale. In an embodiment, return loss is a key parameter that is used to assess the useability of an antenna design with the rest of electronic circuit working cooperatively with the antenna structure. The return loss curve 1100 corresponds to dipole configuration that includes a concrete building construction brick structure. In an embodiment, return loss is a key parameter used to assess the useability of a design of an antenna structure with the rest of circuit, which are generally matched to 50 ohm impedance. The return loss curve is in close proximity to 10 dB for the desired frequency band between 2.0 GHz-2.5 GHz. The return loss curve 1100 indicates an impedance match that is ideal with return loss of 10 dB. With a return loss of 10 dB return loss, smore that 90% of available power is being delivered to dipole configuration of the construction block antenna assembly 900.

Figure 12:
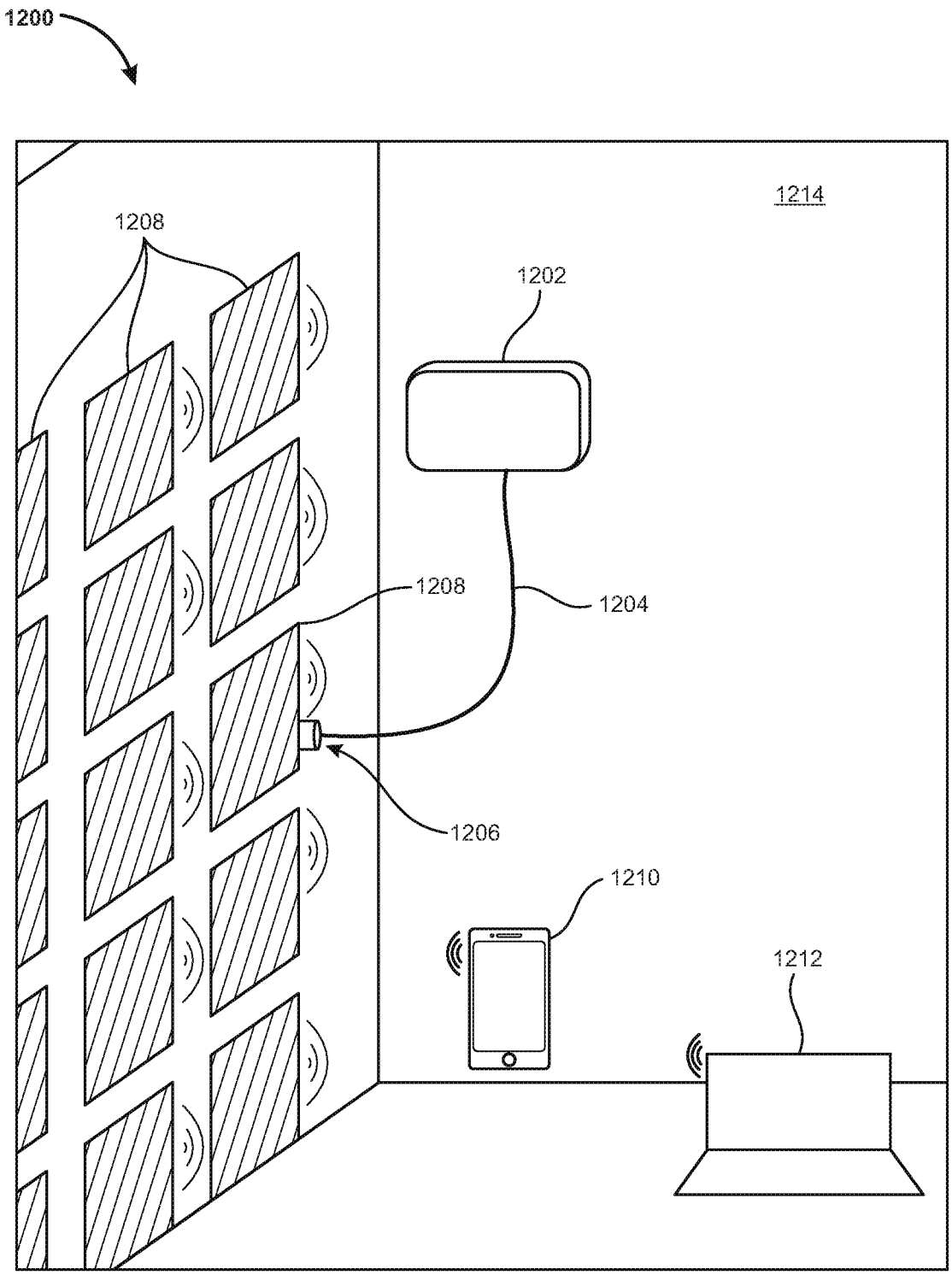
FIG. 12 is a block diagram illustrating a system implementation of construction block antenna assembly, according to an exemplary embodiment.

FIG. 12 is a block diagram illustrating a system 1200 implementation of construction block antenna assembly, according to an exemplary embodiment. Referring to FIG. 12, there is shown a system 1200 that implements the construction block antenna assembly (e.g., 100, 200, 300, 700 and 900). FIG. 12 is described in conjunction with FIGS. 1A-1C, FIGS. 2A-2C, FIG. 3, FIG. 7, and FIG. 9. The construction block antenna assembly (e.g., 100, 200, 300, 700 and 900) may hereinafter be referred to as the antenna structure. In an embodiment, the system 1200 may include a Wi-Fi router or access point 1202 that may be connected to the Internet (not shown). The Wi-Fi router or access point 1202 may include electronic or electrical components, such as transceivers, analog to digital converters (ADC), digital to analog converters (DAC), provision for ethernet connectivity, etc. The provision for Ethernet connectivity may include receiving a connection from the Internet Service Provider (ISP) via local access network (LAN) cable or fiber optic cable. Further, a RF connector 1206 may be connected to the Wi-Fi router or access point 1202 via a wired connection 1204, for example, a coaxial cable. The RF connector 1206 may connect with the antenna structure 1208 (e.g., 100, 200, 300, 700 and 900) via the ports (not shown). In an embodiment, the antenna structure (e.g., 100, 200, 300, 700 and 900) may be a brick structure or a block structure of concrete or wood. The antenna structure 1208 (e.g., 100, 200, 300, 700 and 900) may operate passively, thereby extending the access point for the Wi-Fi router or access point 1202 and provides connection to end devices, like cell phones and laptops (e.g., 1210 and 1212). In an embodiment, the system 1200 is deployed in a room 1214, where the antenna structure 1208 (e.g., 100, 200, 300, 700 and 900) are integral part of the room, for example, side wall, that are passively transmitting and receiving the signal.

In an embodiment, hereinafter the term antenna structure (e.g., 100, 200, 300, 700 and 900) may correspond to any of the configurations described in FIGS. 1A-1C, FIGS. 2A-2C, FIG. 3, FIG. 7, and FIG. 9. The antenna structure (e.g., 100, 200, 300, 700 and 900) eliminates the dependency on active components or elements for functioning or operation of the antenna. The antenna structure (e.g., 100, 200, 300, 700 and 900) may be modified to house more complex antenna assemblies and interface with Radio Frequency (RF) segments, including active components, like phase shifters and RF power amplifiers and low noise amplifiers. In an embodiment, the antenna structure (e.g., 100, 200, 300, 700 and 900) may extend the range or provide additional functionality or operation for using Wi-Fi applications or satellite television dish applications. The antenna structure (e.g., 100, 200, 300, 700 and 900) may further reduce the cost of installation of the antenna by eliminating the usage of any FR4 substrate or practice resonant tunneling electronic (PTFE) based laminate material for the antenna substrate construction. Further the antenna structure (e.g., 100, 200, 300, 700 and 900) may be scalable and signal strength for Wi-Fi coverage may be extended or strengthened depending on the type of infrastructure construction (e.g., a house, an office, etc.). The antenna structure (e.g., 100, 200, 300, 700 and 900) may provision connectivity in geographies or terrains (e.g., rural, desert, etc.) that may not have direct connectivity or access to the Internet. In an embodiment, any infrastructure (e.g., buildings, bridges, wall structures, etc.) may include the antenna structure (e.g., 100, 200, 300, 700 and 900) thereby eliminating the need for an external passive antenna structures. The construction or design or structure of the antenna structure (e.g., 100, 200, 300, 700 and 900) may facilitate converting or transforming any iron oxide-based construction building block structure into a passive antenna, thereby providing seamless wireless connectivity. In an embodiment, the antenna structure (e.g., 100, 200, 300, 700 and 900) may further reduce additional infrastructure costs for telecommunication and internet service providers.

In an embodiment, the antenna structure (e.g., 100, 200, 300, 700 and 900) may provision deployment as a satellite receiver for applications related to reception of television signals from direct-to-home service providers. The antenna structure (e.g., 100, 200, 300, 700 and 900) may eliminate the need of external mounted structures, thereby reducing the overall structural profile of the antenna deployment. In an embodiment, a lower profile antenna for such receivers may reduce a total wind load on the antenna structure (e.g., 100, 200, 300, 700 and 900), and for large antenna structures for example, the ones used for base-stations, the antenna structure can substantially reduce construction and implementation cost.

In an embodiment, the antenna structure (e.g., 100, 200, 300, 700 and 900) may provision reduction of the time for deployment ground stations in regions affected by calamities like cyclones and tornadoes. Low-profile ground stations may deploy the antenna structure (e.g., 100, 200, 300, 700 and 900) as the primary structure and survive through environmental changes such as cross winds. In an embodiment, the radiating portion of the antenna structure (e.g., 100, 200, 300, 700 and 900) may be coated with waterproof membranes or water repellant coatings, such as paints, etc., thereby improving the weather proofing attributes of the antenna structure. Further, the antenna structure (e.g., 100, 200, 300, 700 and 900) may be coated with anticorrosion paints to prevent corrosion of metallic coatings. In an embodiment, the antenna structure (e.g., 100, 200, 300, 700 and 900) may be deployed in ground stations that are geographically located in extreme terrains and weather conditions, thereby eliminating the need to expose the substrates or electronics components such environmental conditions. In an embodiment, repeated exposure of the electronic components or substrates of the antenna structure (e.g., 100, 200, 300, 700 and 900) to aforementioned environmental conditions may reduce operational efficacies or deteriorate typical commercial or industrial grade electronic components. Other electronic components such as the RF front end electronics are shielded from adverse environmental conditions like rain and temperature as they become 'indoor' components.

In an embodiment, an array of the antenna structure (e.g., 100, 200, 300, 700 and 900) may be deployed on roof tops to receive and transmit signals from Wi-Fi hotspots or access points. Low noise amplifiers may be connected to the antenna structure (e.g., 100, 200, 300, 700 and 900) that may provision operation or functioning at desired the frequency. The antenna structure (e.g., 100, 200, 300, 700 and 900) may be reusable thereby reducing the infrastructure costs for the deployment of Wi-Fi hotspots or access points. The array of the antenna structure (e.g., 100, 200, 300, 700 and 900) may provision seamless integration with the construction infrastructure, thereby reducing the design complexity and hence the costs incurred for setting up Wi-Fi hotspots or access points. In an embodiment, the antenna structure (e.g., 100, 200, 300, 700 and 900) may be designed to operate or function in different frequency bands. Further, the antenna structure (e.g., 100, 200, 300, 700 and 900) may be used for construction of infrastructures, such as malls and office buildings for providing integrated access points. The antenna structure may be implemented into the false ceiling structures within such infrastructures, thereby eliminating the need for additional infrastructure or deployment of wireless access points. In an embodiment, the antenna structure (e.g., 100, 200, 300, 700 and 900) may be configured for utility based on applications like industrial, scientific, and medical (ISM) band routers operating in the 2.4 GHz, 5 GHz, etc. Further, the antenna structure may also be configured to operate in a Multiple-in Multiple-out (MIMO) configuration to meet 802.11n and future requirements or additionally advanced communication technologies, like 5G.

While the present disclosure is described with reference to certain embodiments, it will be understood by those skilled in the art that various changes may be made, and equivalents may be substituted without departure from the scope of the present disclosure. In addition, many modifications may be made to adapt a particular situation or material to the teachings of the present disclosure without departure from its scope. Therefore, it is intended that the present disclosure is not limited to the particular embodiment disclosed, but that the present disclosure will include all embodiments that fall within the scope of the appended claims.

What is claimed is:

1. An antenna structure, comprising:

a building construction block structure configured to provide a non-radiating portion of the antenna structure;

a radiating element formed on at least one side of the building construction block, configured to provide a radiating portion of the antenna structure, wherein the radiating element is provided by a coating of a metallic patch; and a ground plane spaced apart from the radiating element on the building construction block structure, wherein the ground plane includes partially a portion of the radiating element configured to adhere to the building construction block structure of the antenna structure.

2. The antenna structure of claim 1, wherein the building construction block structure is one of a wooden block structure and a concrete block structure, wherein the concrete block structure is one of cement, silica sands, styrene acrylic based polymers and non-combustible fillers thereof.

3. The antenna structure of claim 2, wherein the concrete block structure is selected from the group consisting of a hollow concrete block, an aerated autoclaved concrete block, concrete bricks, solid concrete block, lintel block and concrete stretcher block.

4. The antenna structure of claim 1, wherein the radiating element is formed in a predefined portion on at least one side of the building construction block structure.

5. The antenna structure of claim 1, wherein the coating of the metallic patch including the radiating element comprises a copper layer.

6. The antenna structure of claim 1, further comprising one or more antenna ports, wherein a connector is coupled to the ground plane by a metallic glazed contact, and wherein the metallic glazed contact is in contact with the one or more antenna ports.

7. The antenna structure of claim 1, further comprising:

a dielectric substrate; and a radiating element coated over the dielectric substrate, wherein the dielectric substrate is configured to be adhesively adhered to the building construction block structure.

8. The antenna structure of claim 7, wherein the radiating element is configured to provide a radiating portion of the antenna structure.

9. An electronic communication device, comprising:

a building construction block structure configured to provide a non-radiating portion of the electronic communication device;

a radiating element formed on at least one side of the building construction block, configured to provide a radiating portion of the electronic communication device, wherein the radiating element is provided by a coating of a metallic patch; and a ground plane spaced apart from the radiating element on the building construction block structure, wherein the ground plane includes partially a portion of the radiating element configured to adhere to the building construction block structure of the electronic communication device.

10. The electronic communication device of claim 9, wherein the building construction block structure is one of a wooden block structure and a concrete block structure, wherein the concrete block structure is one of cement, silica sands, styrene acrylic based polymers and non-combustible fillers thereof.

11. The electronic communication device of claim 10, wherein the concrete block structure is selected from the group consisting of a hollow concrete block, an aerated autoclaved concrete block, concrete bricks, solid concrete block, lintel block and concrete stretcher block.

12. The electronic communication device of claim 9, wherein the radiating element is formed in a predefined portion on at least one side of the building construction block structure.

13. The electronic communication device of claim 9, wherein the coating of the metallic patch including the radiating element comprises a copper layer.

14. The electronic communication device of claim 9, further comprising one or more antenna ports, wherein a connector is coupled to the ground plane by a metallic glazed contact, and wherein the metallic glazed contact is in contact with the one or more antenna ports.

15. The electronic communication device of claim 9, further comprising:

a dielectric substrate; and a radiating element coated over the dielectric substrate, wherein the dielectric substrate is configured to be adhesively adhered to the building construction block structure.

16. The electronic communication device of claim 15, wherein the radiating element is configured to provide a radiating portion of the electronic communication device.

* * * * *